US009642408B2

(12) United States Patent
Inghirami

(10) Patent No.: US 9,642,408 B2
(45) Date of Patent: May 9, 2017

(54) METHOD AND SYSTEM FOR MAKING TAILORED GARMENTS

(71) Applicant: IN.PRO.DI—INGHIRAMI PRODUZIONE DISTRIBUZIONE S.P.A., Milan (IT)

(72) Inventor: Giovanni Inghirami, Sansepolcro (IT)

(73) Assignee: IN.PRO.DI—INGHIRAMI PRODUZIONE DISTRIBUZIONE S.p.A., Milan (IT)

( * ) Notice: Subject to any disclaimer, the term of this patent is extended or adjusted under 35 U.S.C. 154(b) by 0 days.

(21) Appl. No.: 14/442,435

(22) PCT Filed: Nov. 12, 2013

(86) PCT No.: PCT/IB2013/060073

§ 371 (c)(1),
(2) Date: May 13, 2015

(87) PCT Pub. No.: WO2014/076633

PCT Pub. Date: May 22, 2014

(65) Prior Publication Data

US 2016/0249699 A1 Sep. 1, 2016

(30) Foreign Application Priority Data

Nov. 16, 2012 (IT) ..... BO2012A0628

(51) Int. Cl.
*G06F 19/00* (2011.01)
*A41H 1/00* (2006.01)
(Continued)

(52) U.S. Cl.
CPC ..... *A41H 1/00* (2013.01); *A41H 3/00* (2013.01); *A41H 3/007* (2013.01); *A41H 42/00* (2013.01); *D05B 19/12* (2013.01)

(58) Field of Classification Search
CPC ... A41H 1/00; A41H 1/02; A41H 1/10; A41H 3/10; A41H 42/00
(Continued)

(56) References Cited

U.S. PATENT DOCUMENTS 5,530,652 A * 6/1996 Croyle ..... A41H 1/02 700/130
5,956,525 A * 9/1999 Minsky ..... A41H 1/02 33/15
(Continued)

FOREIGN PATENT DOCUMENTS

WO 2011/142655 11/2011

OTHER PUBLICATIONS

International Search Report dated Jan. 27, 2014 for corresponding patent application No. PCT/IB2013/060073.

*Primary Examiner* — Nathan Durham
(74) *Attorney, Agent, or Firm* — Wegman, Hessler & Vanderburg

(57) ABSTRACT

A method for allowing a user to make a tailored garment (M) comprises the following steps: preparing at least one image (I) comprising a sample garment (C) of the same type as the tailored garment (M) to be made and also comprising a reference object (O) with actual standardized dimensions (M7,M8); measuring on the at least one image (I) the dimensions of the reference object (O) and a set of basic dimensions (M1,M2,M3,M4,M5,M6) of the sample garment (C); calculating the actual dimensional values of the set of basic dimensions of the sample garment (C) as a function of: the dimensional values of the set of basic dimensions (M1,M2,M3,M4,M5,M6) of the sample garment (C) measured on the image (I), the dimensional values of the reference object (O) and the actual dimensions (M7,M8) of the reference object (O); selecting the aesthetic features of the tailored garment (M) to be made; transmitting to a
(Continued)

tailoring apparatus (4) the calculated actual dimensional values of the set of basic dimensions of the sample garment (C) and the selected aesthetic features; performing on the tailoring apparatus (4) a sequence of operations of cutting and sewing the tailored garment (M), to make the tailored garment (M) so its basic dimensions are substantially equal to the previously calculated actual dimensional values of the set of basic dimensions of the sample garment (C).

16 Claims, 3 Drawing Sheets

(51) Int. Cl.
*A41H 3/00* (2006.01)
*A41H 42/00* (2006.01)
*D05B 19/12* (2006.01)

(58) Field of Classification Search
USPC ..... 700/130–133
See application file for complete search history.

(56) References Cited

U.S. PATENT DOCUMENTS 6,415,199 B1 * 7/2002 Liebermann ..... A41H 1/02 700/132
6,490,534 B1 12/2002 Pfister
7,058,471 B2 * 6/2006 Watanabe ..... A41H 3/007 700/132
2005/0283267 A1 * 12/2005 Bingham ..... A41H 3/007 700/132
2006/0287877 A1 * 12/2006 Wannier ..... G06Q 30/0601 700/132
2014/0300722 A1 * 10/2014 Garcia ..... G06T 7/602 348/77

* cited by examiner

METHOD AND SYSTEM FOR MAKING TAILORED GARMENTS

TECHNICAL FIELD

This invention relates to a method and a system for making tailored garments.

In the clothing sector, a strongly felt need is that of allowing a user to quickly and easily make a garment, for example a shirt, which is tailored to size.

BACKGROUND ART

At present, one course of action that can be followed by a customer wishing to acquire a tailor-made garment is to go personally to a specialist tailor or dressmaker who takes the measurements for the garment directly on the customer's body.

Generally speaking, the tailor or dressmaker works in a shop or other establishment.

According to this course of action, when the body measurements are taken, the customer also chooses the other features of the garment to be made (colour, style, type of fabric, and so on) and together with the tailor/dressmaker makes arrangements for when the garment can be completed and delivered.

According to an alternative course of action, the customer sends a sample garment to a specialist centre. The necessary measurements are taken directly from the sample and the garment is returned directly to the customer.

This course of action, too, however, is complicated and requires the customer to do without a particular garment for a certain period of time. Also known are systems and methods for automatically obtaining garment length data which entail capturing a photograph of the body of the person who is going to wear the garment.

These systems are relatively complicated and unreliable in terms of the garment size obtained unless they require the user to enter certain measurements directly (such as, for example, certain length measurements of the wearer's body).

Moreover, these systems and methods do not meet the need to allow a garment to be tailored to size without requiring the presence of the person who is going to wear it (for example, because that person is unable to be present or because the buyer intends to make a surprise gift).

DISCLOSURE OF THE INVENTION

This invention has for an aim to meet the above mentioned needs, in particular that of allowing a garment to be tailored to size in a particularly quick and easy manner.

Another arm of the Invention is to allow a garment to be tailored to size quickly and easily without the customer having to go to a shop personally, that is to say, without requiring the presence of the person who is going to wear the garment.

BRIEF DESCRIPTION OF THE DRAWINGS

The technical features of the invention, with reference to the above aims, are clearly described in the appended claims and its advantages are more apparent from the detailed description which follows, with reference to the accompanying drawings which illustrate a preferred, non-limiting example embodiment of the invention and in which FIG. 1 schematically represents a preferred embodiment of a system for making garments according to the invention;

DETAILED DESCRIPTION OF PREFERRED EMBODIMENTS OF THE INVENTION

The invention defines a method and a system 1 for allowing a user to make a garment M which is tailored to size.

Described first is the system 1 which allows a user to make a tailored garment M and which allows implementing the method of the invention for allowing a user to make a tailored garment M.

The system 1 for allowing a user to make a garment M tailored to size comprises:

- a tailoring apparatus equipped with means for cutting and sewing a garment;
- a plurality of operating instructions configured to be loaded into at least one processor 2' in such a way as to allow performance of the following steps or operations:
- measuring on at least one captured (received) image I, representing (comprising) a sample garment C of the same type as the tailored garment M to be made and also representing a reference object O with actual standardized (and known) dimensions, the dimensions of the reference object O and a plurality of basic dimensions (M1,M2,M3,M4,M5,M6) of the sample garment C;
- calculating the actual dimensional values of the set of basic dimensions (M1,M2,M3,M4,M5,M6) of the sample garment C as a function of:
- the dimensional values of the set of basic dimensions (M1,M2,M3,M4,M5,M6) of the sample garment C measured on the at least one image I;
- the dimensional values of the reference object O measured on the image I,
- and the information on the actual dimensions (M7,M8) of the reference object O;
- selecting the aesthetic features of the tailored garment M to be made;
- transmitting to the tailoring apparatus 4 the calculated actual values of the set of basic dimensions (M1,M2, M3,M4,M5,M6) of the sample garment C and the selected aesthetic features.

The tailoring apparatus 4 is equipped with cutting and sewing means configured to allow performing a sequence of operations of cutting and sewing the garment M based on calculated actual values of the dimensions of the sample garment C and of the selected aesthetic features transmitted to it, in order to make the tailored garment M so its basic dimensions (M1,M2,M3,M4,M5,M6) are substantially equal to the actual values of the basic dimensions of the sample garment C and so it also has the selected aesthetic features.

It should be noted that the expression "basic dimensions" is used to mean the essential measurements needed to make the desired garment.

Figure 2:
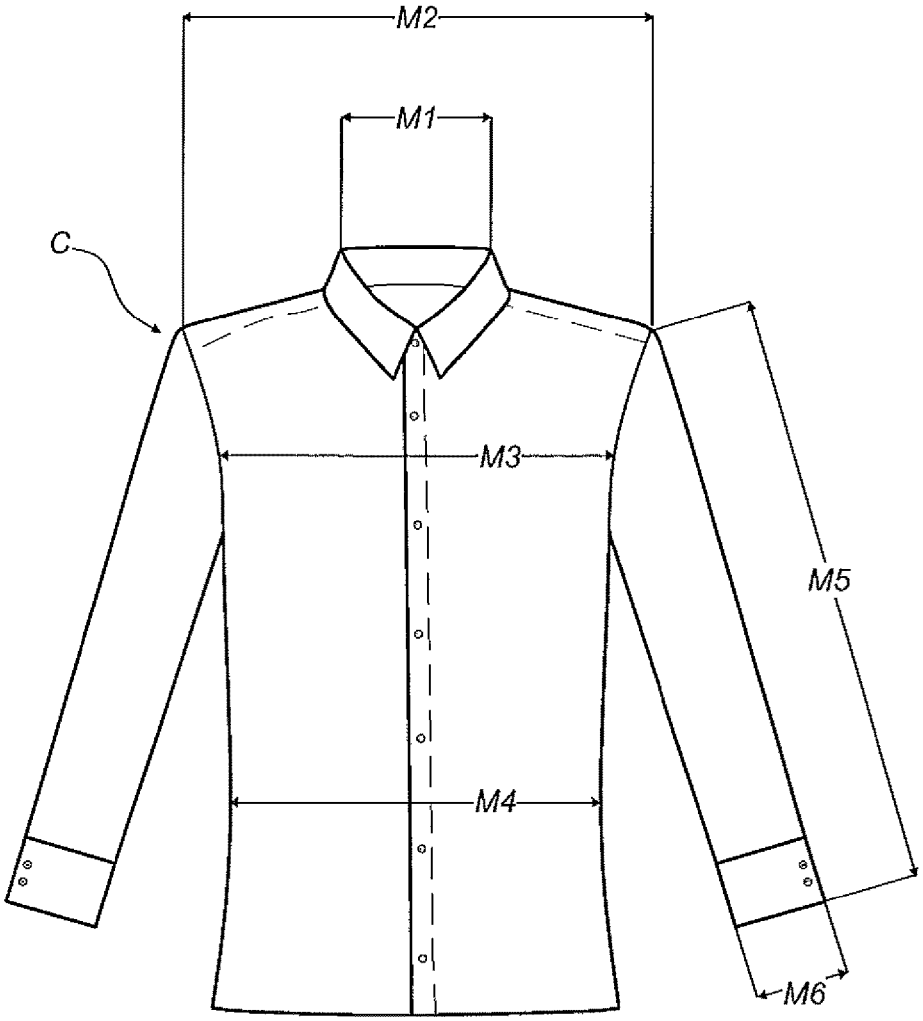
FIG. 2 schematically illustrates a sample garment.

For example, in the case of a shirt, the basic dimensions may be one or more of the following measurements (as shown in FIG. 2):

- collar circumference (M1);
- shoulder width (M2);
- chest (M3);
- waist (M4);

arm length (M5);

cuff circumference (M6).

It should be noted that the captured image is a photograph captured by the user, with the sample garment C and the reference object positioned within the field of view of the device used for capturing the image.

Also, the expression "object with standardized dimensions" means an object whose dimensions are known and substantially identical between different specimens.

More specifically, the object with standardized dimensions has dimensions which are identical between different specimens of it, even of different brands.

Preferably, the object O may be a bank debit card.

Preferably, the object O may be a standard size sheet (for example, a size A4 sheet).

Also preferably, the object O may comprise a flat element with a plurality of references (dots/lines) arranged according to a known and predetermined geometric pattern.

It should be noted that in a preferred embodiment of the method, the user takes a photograph of the sample garment C and of the reference object O.

The photograph may be taken with a camera, a smartphone, a tablet or, more generally, any device capable of capturing photographs.

Preferably, the reference object O is a bank debit card, a credit card or a shopping card (purposely shown enlarged in the accompanying drawings). It should be noted that, in more general terms, the reference object O is any object O whose dimensions are standardized (that is, identical between different specimens) and known.

It should also be noted that according to the method of the invention, the sample garment C and the reference object O are present in the same image I.

According to this aspect, the reference object O is usually located in the proximity of (preferably in contact with) the sample garment C so as to capture a photograph comprising both the reference object O and the sample garment C.

During capture of the image, the reference object O preferably, but not necessarily. This in the same focal plane as the sample garment C.

Figure 1:
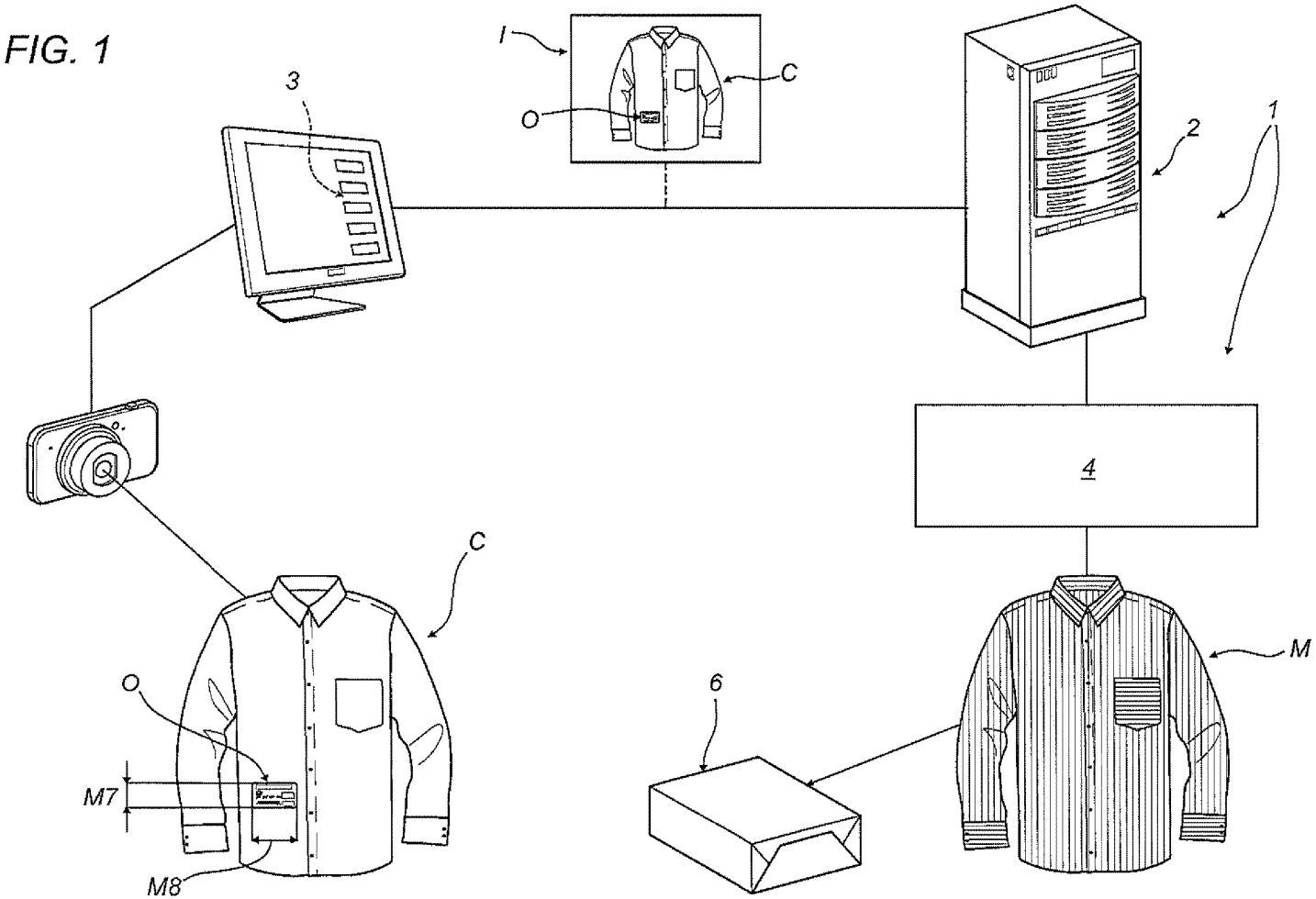

The sample garment C is preferably placed on a supporting surface and the reference object O is placed on the same supporting surface. Still more preferably, the reference object O is placed on the sample garment C (as illustrated in FIG. 1).

It should also be noted that the sample garment C is a garment whose dimensions are optimal for the end user, that is to say, whose basic dimensions (M1,M2,M3,M4,M5,M6) define a reference for the tailored garment M to be made.

Thus, the dimensions of the tailored garment M that will be made will be substantially identical to those of the sample garment C.

The operation of measuring on the captured image I the dimensions of the reference object O and a set of basic dimensions (M1,M2,M3,M4,M5,M6) of the sample garment C comprises taking from the image I certain measurements of the two objects present in the image, namely, the reference object O and the sample garment C.

It should be noted that the dimensions of the reference object O are preferably measured before measuring the set of basic dimensions (M1,M2,M3,M4,M5,M6) of the sample garment C, as described in more detail below.

These operations thus entail taking certain measurements of the reference object O and of the sample garment C by extracting them from the image I (these measurements are preferably expressed in pixels).

More specifically, during these measuring operations, at least the measurements of the basic dimensions (M1,M2,M3,M4,M5,M6) of the sample garment C are taken from the image I.

Thus, this measuring step (which may be performed concurrently or in successive stages for the two objects, namely, the sample garment C and the reference object O, respectively) allows the measurements of the reference object O and of the sample garment C to be derived.

The method also comprises a calculating step whereby the actual dimensions of the sample garment C, that is, the real measurements of the sample garment C, are calculated.

It should be noted that the expression "actual dimensions" is used to mean the real measurements of an object (expressed in any suitable unit of length measurement, such as, for example, meters or inches).

The step of calculating the actual dimensional values of the set of basic dimensions (M1,M2,M3,M4,M5,M6) of the sample garment C involves using at least the following three different items of information (directly or indirectly, since these items of information can also be used in a step preceding the calculation step, for example, the step of preparing an intermediate image on which the calculation is performed later):

- the dimensional values of the set of basic dimensions (M1,M2,M3,M4,M5,M6) of the sample garment C measured on the image I,
- the dimensional values of the reference object O measured on the image I,
- the information on the actual dimensions (M7,M8), that is, the real measurements, of the reference object O.

It should be noted that by comparing the dimensional values measured on the image I of the reference object O with the information on the actual dimensions, that is, the real measurements, of the reference object O, it is possible to calculate the "actual value", that is, the real value of the width and length of each pixel of the image (in the focal plane which the reference object O lies in).

In other words, the information regarding the dimensional values measured on the image I of the reference object O and the information regarding the actual dimensions, that is, the real measurement, of the reference object O are compared to calculate one or more parameters allowing the measurements of any object captured (taken) from the image (in pixels) to be correlated with the actual dimensions, that is, the real measurements (in meters, inches or other unit of measurement).

This/these parameter/parameters can preferably be calculated along two orthogonal directions of the image I (length and width).

This/these parameter/parameters is/are used to calculate the actual dimensions, that is, the real measurements, of the set of basic dimensions (M1,M2,M3,M4,M5,M6) of the sample garment C, based on the dimensions of the sample garment C measured on the image I (expressed in pixels).

It should be noted that, preferably, the system 1 is configured to calculate only some of the dimensions of the sample garment C, in particular, those dimensions (M1,M2,M3,M4,M5,M6) which are necessary for making the tailored garment M (referred to as basic dimensions).

The step of selecting the aesthetic features (colour, fabric, accessories, etc.) of the tailored garment M to be made can be performed in different alternative ways.

These aesthetic features comprise, by way of non-limiting example, the colour, the type of fabric, the accessories and other features of the garment to be made.

In a first possible alternative, the user selects the aesthetic features from a database (that is, from a catalogue).

The database is accessible from an interface 3 and contains information for customizing the garment M.

According to this aspect, therefore, the system 1 of this invention comprises a database containing customizing information and instructions configured to allow the user to select the customizing information from the database.

This database preferably resides in a remote processor 2. In a second possible alternative (illustrated in FIG. 3), the user selects the aesthetic features in the manner described below.

The user captures a further image I2 (for example by taking a photograph) of a further garment E having desired aesthetic features.

The further garment E having desired aesthetic features is of the same type as the sample garment C (for example, they are both shirts). The garment E, however, need not be of the same size as,—that is to say, it may be smaller or larger than,—the garment M that will be made.

Figure 3:
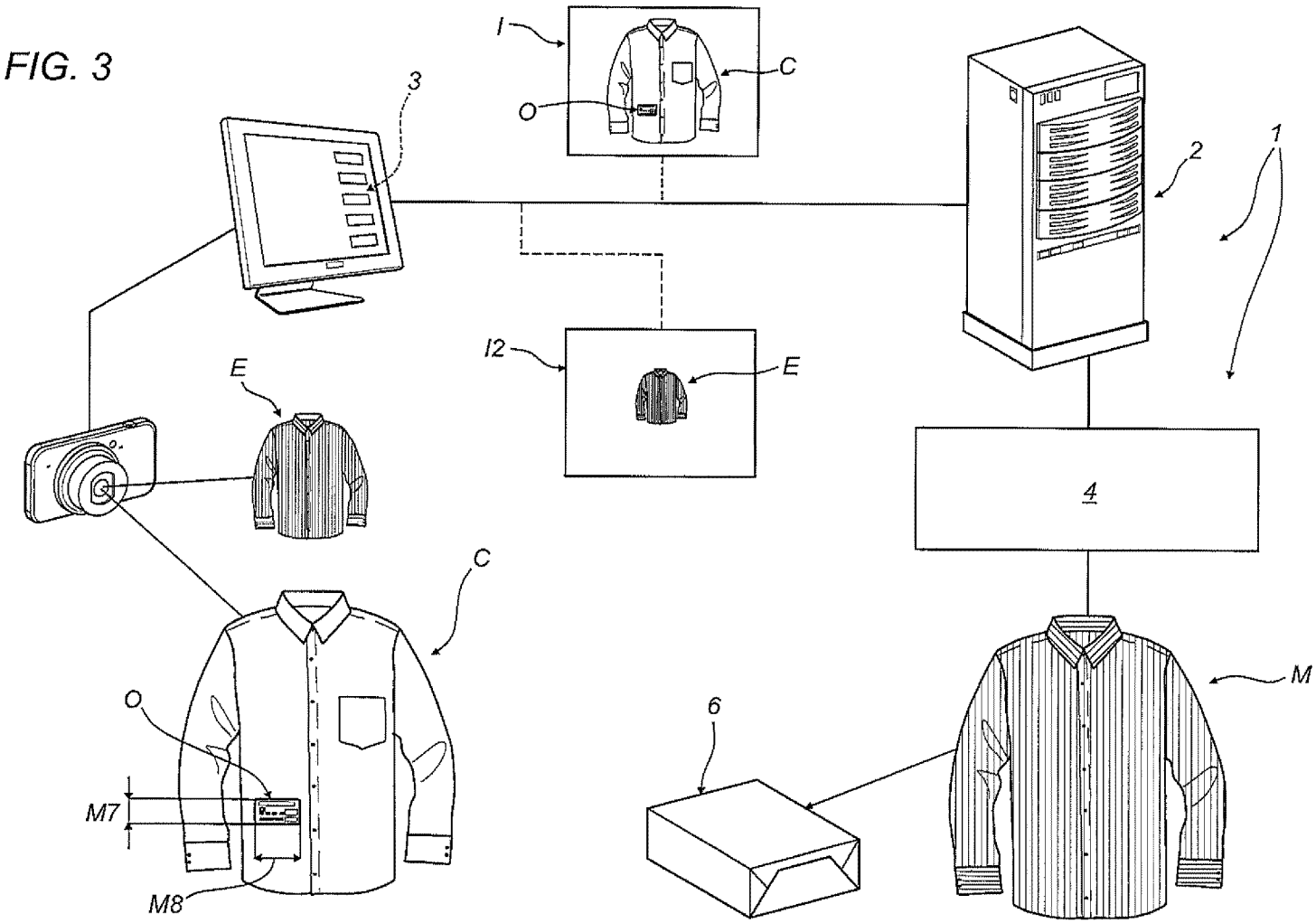
FIG. 3 schematically illustrates a further embodiment of the system for making garments according to the invention.

That means the user is free to choose exactly what the finished garment M will eventually look like, thus obtaining a high level of customization. According to this aspect, the further image I2, or alternatively, information from the further image I2, is sent to the tailoring apparatus 4 in order to make a garment M whose aesthetic appearance is substantially the same as that of the further garment E (as illustrated in FIG. 3).

Described below, with reference to FIG. 1, is a preferred embodiment of the system 1 of the invention.

Preferably, the operating instructions described above reside in a processor 2.

Still more preferably, the operating instructions described above reside in a remote processor 2 (remote in the sense of far from the user U).

Preferably, at least a portion of the instructions is configured to give the user access to an interface 3 able to allow:

- entry of the image I representing the sample garment C of the same type as the tailored garment M to be made and a reference object O with actual dimensions which are standardized and known;
- selection of the aesthetic features of the tailored garment M to be made (when a further garment I2 containing a reference garment having desired aesthetic features is not used).

It should be noted that the user connects up to the remote server 2 through a PC, a smartphone, a tablet or other similar electronic device, and enters the captured image I in the interface 3 of the remote processor 2.

The user preferably also connects up to the remote server 2 through a PC, a smartphone, a tablet or other similar device to select the aesthetic features.

Further, the same portion of instructions is preferably configured to allow the user to log in through the interface 3 (preferably by displaying a field for entering username and password).

One advantage of the invention is that it provides a system 1 which allows the user to make a tailored garment M without the user having to go personally to any specialist or shop to have measurements taken directly from the body of the user (which means that the user can advantageously make the tailored garment as a surprise gift to a third person).

In effect, the measurements are taken directly from an image I of the sample garment C by the above described procedure, in a particularly easy and accurate manner.

Also, use of a standardized reference object O, such as, for example, a credit card or a bank debit card makes it particularly easy to obtain the basic dimensions (M1,M2,M3,M4,M5,M6) of the sample garment C, while maintaining a high level of accuracy.

The system 1 for making a tailored garment M is particularly suitable for the production of shirts, that is to say, for tailoring shirts to size.

The system 1 can also be used for making footwear to size: in this case, instead of the sample garment C, a sample shoe or other item of footwear will be used.

Also defined by the invention is a method for allowing a user to make a tailored garment M and comprising the following steps:

- preparing at least one image I of a sample garment C of the same type as the tailored garment (M) to be made and of a reference object O with actual dimensions (M7,M8) which are standardized and known;
- measuring on the at least one image I the dimensions of the reference object O and a set of basic dimensions (M1,M2,M3,M4,M5,M6) of the sample garment C;
- calculating the actual dimensional values of the set of basic dimensions (M1,M2,M3,M4,M5,M6) of the sample garment C as a function of:
- the dimensional values of the set of basic dimensions (M1,M2,M3,M4,M5,M6) of the sample garment C measured on the image I,
- the dimensional values of the reference object O measured on the image I,
- and the actual dimensions (M7,M8) of the reference object O;
- selecting the aesthetic features of the tailored garment M to be made;
- transmitting to a tailoring apparatus 4 the calculated actual dimensional values of the set of basic dimensions (M1,M2,M3,M4,M5,M6) of the sample garment C and the selected aesthetic features;
- performing on the tailoring apparatus 4 a sequence of operations of cutting and sewing the tailored garment M, to make the tailored garment M so its basic dimensions are substantially equal to the previously calculated actual dimensional values of the set of basic dimensions (M1,M2,M3,M4,M5,M6) of the sample garment C and so it has also the selected aesthetic appearance.

It should be noted that completion of the garment is followed by a step of sending it to the user.

Preferably, therefore, the garment made is placed in a package 6 and sent to the address specified by the user.

Alternatively, the garment may be collected from a shop selected by the user.

It should be noted that the cutting and sewing operations may be performed in a fully automated manner or one or more cutting and/or sewing steps may be performed manually.

Described below are further specific aspects of the system 1 and of the method of the invention, which make measurement of the sample garment C on the image thereof particularly reliable.

Preferably, before the step of measuring on the at least one image I a set of basic dimensions (M1,M2,M3,M4,M5,M6) of the sample garment C, there is a step of preliminarily processing the image I.

The step of preliminarily processing the image I may comprise a step of converting the image to a predetermined graphical format (preferably, JPG format).

Furthermore, still more preferably, if the image I is provided in a format (RAW, NEF) with which EXIF data are associated, the method may comprise a step of extracting the EXIF data so that the image can, at a later stage, be corrected as a function of the EXIF data.

The method then comprises a step of identifying the edges of the reference object O (and of the sample garment C present in the image I).

The step of identifying the edges comprises a preliminary step of converting the image I (provided by the user) to greyscale.

The step of identifying the edges also comprises a step of applying a contrast filter (preferably a "binary threshold" filter) to the image I provided by the user (or to an image derived from the one provided by the user, for example the one converted to greyscale).

Also, preferably, the step of identifying the edges comprises a step of applying a blur filter (preferably a "median blur" and/or a "Gaussian blur" filter) to the image I provided by the user (or to an image derived from the one provided by the user, for example the one converted to greyscale).

Advantageously, the step of applying a blur filter allows better results to be obtained in the subsequent step of identifying the reference object O. In effect, the blur filter makes it possible to obtain an image with reduced "noise" so that the edges of the object O and of the sample garment C can be identified more easily.

It should be noted that the contrast filter and the blur filter are applied, preferably, cyclically, varying at each iteration of the cycle the maximum contrast (from 255 to 0) of the contrast filter and the amplitude of the blur filter (from the maximum to the minimum blur value).

In practice, the method comprises performing a plurality of iterations of applying the contrast filter and the blur filter, where the contrast filter and the blur filter are applied to the same starting image and, at each iteration, one or more control parameters of the contrast filter and/or of the blur filter are set to different values.

Performing a plurality of iterations with different control parameters of the contrast filter and/or of the blur filter makes it possible to obtain a plurality of processed images from which to select an optimum image for the subsequent step of detecting the edges.

Thus, the method comprises a step of applying a contrast filter and a blur filter cyclically in order to obtain a plurality of processed images, each processed image being obtained with predetermined first operating parameters of the contrast filter and predetermined second operating parameters of the blur filter. The method further comprises a step of selecting an image from among these processed images and performing on the selected image or on a processing of the selfsame selected image the step of calculating the actual dimensional values of the set of basic dimensional measurements (M1, M2,M3,M4,M5,M6) of the sample garment C.

Thus, the method comprises a step of selecting an image from among the plurality of processed images.

It should be noted that, according to the method, the step of detecting the edges comprises a step of applying a filter for detecting the edges (of the reference object O and of the sample garment C), that is, an edge detection filter.

In practice, the edge detection filter allows detecting in the processed image (to which the contrast filter and/or the blur filter has been applied) or in the original image the edges of the objects present in the image which may be approximated to polygons and/or closed curves.

Preferably, but without limiting the invention, the edge detection filter is a Canny filter.

If the aforementioned cycle fails to detect the edges correctly, the method comprises a step of cropping a part of the image from the edges towards the centre.

The above described steps of applying a contrast filter and a blur filter and of detecting the edges are performed on the cropped image.

It should be noted that the method further comprises a step of identifying the reference object O in the processed image, that is, in the image to which the edge detection filter has been applied.

For this purpose, the method entails comparing the geometries of the objects detected in the image with a geometry of the reference object O stored in the memory in order to identify the reference object O from among the objects detected in the image.

If the reference object O cannot be identified (for example because it is not in the image or because its contrast against the background is not high enough, preventing it from being identified), this embodiment of the method entails iterating the contrast and blur filter cycle again with different operating parameters from those already used and repeating the step of identifying the reference object O in the processed image by means of the filters.

Next, if the reference object is correctly identified, the method comprises a step of identifying the sample garment C present in the processed image.

For this purpose, the method may comprise a step of comparing the objects identified in the image with a geometry of the sample garment C stored in the memory.

That way, the geometry of the sample garment C is obtained which can be used to derive the basic measurements (of relevance) to obtain the tailored garment.

In practice, the method comprises a step of identifying the profile (edges) of the sample garment C in the image.

It should be noted that before actually calculating the basic measurements, the method may comprise a step of perspective correction of the Image.

It should be noted that in this step of perspective correction, the geometry (edges) of the reference object O obtained from the image is compared with a reference geometry (edges) stored in the memory in order to obtain a perspective correction to be applied to the image.

This comparison more specifically entails comparing one or more dimensions of the reference object obtained from the image with one or more corresponding theoretical dimensions of the reference object stored in the memory (for example in a database).

This comparison may preferably comprise comparing one or more functions (ratios) of dimensional values of the reference object obtained from the image and dimensional reference vales stored in the memory, such as, for example, height and width.

For example, one specific embodiment comprises a step of comparing the ratio of height to width of the reference object O obtained from the image with that stored in the memory.

If these ratios (the one obtained from the image and the one stored in the memory) differ, it may indicate that the reference object was not lying in a plane at right angles to the optical axis of the image capturing device.

In the step of perspective correction, the method comprises a step of creating a corrected image, obtained as a function of the results for the aforementioned comparison (so that the difference between one or more dimensions of the reference object obtained from the image and one or more corresponding dimensions of the reference object stored in the memory is minimal).

In practice, the processed or captured image is rotated (in one or more planes, that is, about one or more axes) in such a way as to correct capture errors (sample garment C and reference object O do not lie in a plane at right angles to the optical axis of the image capturing device) or distortions due to the optical properties of the image capturing device. Preferably, the image is rotated about the centre of the image itself.

It should be noted that in this step, from the comparison between the original image and the corrected image is derived a perspective correction matrix containing the correction data to be applied to each pixel in order to convert the original image to the corrected one.

It should be noted that on the corrected image it is possible to measure distances between points on the edge of the object to be measured, that is to say, measurements of the garment C can be taken.

It should be noted that that any segment can be measured on the corrected image.

It should be noted that during image capture, the reference object O is preferably at the centre of the image I.

Also to be noted is that according to the method of the invention, the reference object O and the sample garment C are preferably positioned in the same image capture plane.

With reference to the captured measurements of the garment C, where the garment is a shirt, these measurements are preferably the following:

- the concave angle points on the closed lines on the left and right of the collar, which can be joined to give a segment whose midpoint is the centre of the base of the collar from which a line can be drawn perpendicularly to the lower edge of the shirt to obtain the length of the shirt;
- the midpoint of the left cuff which, if joined to the above mentioned midpoint of the base of the collar gives the segment corresponding to the length of the sleeve;
- the concave angle points on the closed lines underarm right and left which can be joined to draw the segment of the chest measurement;
- the right and left base line points which can be joined to draw the segment of the shirt inform measurement;
- the right and left points of intersection between the edge of the shirt body and the perpendicular to the length segment approximately ⅓ of the way up froth the bottom Which can be joined to draw the segment corresponding approximately to the waist measurement.

Preferably, the step of preparing at least one image I of the sample garment C and of the reference object O comprises preparing a single image I of the sample garment C and of the reference object O.

Further, according to another aspect, there is also a step of transmitting the at least one image I of the sample garment C and of the reference object O to a processor 2.

Also, according to this aspect, the step of measuring on the at least one image I the dimensions of the reference object O and a set of basic dimensions (M1,M2,M3,M4,M5, M6) of the sample garment C and the step of calculating the actual dimensional values of the basic dimensions (M1,M2, M3,M4,M5,M6) of the sample garment C are performed on the processor 2.

According to yet another aspect, the step of selecting the aesthetic features of the tailored garment M to be made comprises selecting the aesthetic features of the tailored garment M from a database.

According to a yet further aspect, the step of selecting the aesthetic features of the tailored garment M to be made comprises the further steps of:

- capturing a further image I2 of a further garment E having reference aesthetic features;
- transmitting the further image I2 or information derived from that further image I2 to the tailoring apparatus 4, in order to make a garment whose aesthetic appearance is substantially the same as the further garment E having the reference aesthetic features.

It is very clear that the method and system 1 of the invention make it possible to considerably simplify the process of producing a tailored garment and to obtain a customized garment which is tailored to size.

Also defined is an Information technology product comprising a plurality of instructions configured to implement the method described in the foregoing.

The invention claimed is:

1. A method for allowing a user to make a tailored garment, characterized in that it comprises the following steps:

- preparing at least one image comprising a sample garment of the same type as the tailored garment to be made and also comprising a reference object with actual standardized dimensions;
- measuring on the at least one image the dimensions of the reference object and a set of basic dimensions of the sample garment;
- calculating the actual dimensional values of the set of basic dimensions of the sample garment as a function of: the dimensional values of the set of basic dimensions of the sample garment measured on the image, the dimensional values of the reference object measured on the image, and the actual dimensions of the reference object;
- selecting the aesthetic features of the tailored garment to be made;
- transmitting to a tailoring apparatus the calculated actual dimensional values of the set of basic dimensions of the sample garment and the selected aesthetic features;
- performing on the tailoring apparatus a sequence of operations of cutting and sewing the tailored garment, to make the tailored garment so its basic dimensions are substantially equal to the previously calculated actual dimensional values of the set of basic dimensions of the sample garment and so it has also the selected aesthetic appearance.

2. The method according to claim 1, comprising, before the step of calculating the actual dimensional values of the set of basic dimensions of the sample garment, a step of identifying the edges of the reference object and of the sample garment and wherein the calculation of the actual dimensional values of the set of basic dimensions is performed on the detected edge of the sample garment.

3. The method according to claim 1, comprising, before the step of measuring on the at least one image the dimensions of the reference object and a set of basic dimensions of the sample garment, a step of adjusting the contrast in the image of the sample garment, in order to obtain a processed image on which to perform the step of measuring the dimensions of the reference object and a set of basic dimensions of the sample garment.

4. The method according to claim 3, wherein the step of adjusting the contrast and of deblurring are performed cyclically on the same image to obtain a plurality of processed images, where each processed image is obtained with predetermined first operating contrast parameters and with second operating blur parameters, and further comprising a step of selecting an image from among the processed images in order to perform on the selected image or on a processing of the selfsame selected image the step of calculating the actual dimensional values of the set of basic dimensions of the sample garment.

5. The method according to claim 1, comprising, before the step of measuring on the at least one image the dimensions of the reference object and a set of basic dimensions of the sample garment, a step of deblurring the image comprising the sample garment, in order to obtain a processed image on which to perform the step of measuring the dimensions of the reference object and a set of basic dimensions of the sample garment.

6. The method according to claim 1, comprising, before the step of measuring on the at least one image a set of basic dimensions of the sample garment, a step of perspective correction of the image based on comparing dimensions measured on the image of the reference object with stored dimensions of the reference object.

7. The method according to claim 6, wherein the step of perspective correction comprises a step of rotating the image about at least one axis of rotation based on comparing the dimensions measured on the image of the reference object with the stored dimensions of the reference object.

8. The method according to claim 1, wherein the image made available is captured with the sample garment and the reference object positioned on the same supporting surface.

9. The method according to claim 1, wherein the step of preparing at least one image of the sample garment and of the reference object comprises preparing a single image of the sample garment and of the reference object.

10. The method according to claim 1, wherein the steps of: measuring on the at least one image the dimensions of the reference object and a plurality of basic dimensions the sample garment; and calculating the actual dimensional values of the set of basic dimensions of the sample garment are performed on a processor.

11. The method according to claim 1, wherein the step of selecting the aesthetic features of the tailored garment to be made comprises selecting the aesthetic features of the tailored garment from a database residing in a processor through an interface.

12. The method according to claim 1, wherein the step of selecting the aesthetic features of the tailored garment to be made comprises the further steps of; preparing a further image of a further garment having desired aesthetic features; transmitting the further image or information derived from that further image to the tailoring apparatus, in order to make a tailored garment whose aesthetic appearance is substantially equal to the further garment.

13. The method according to claim 1, wherein the reference object is a credit card or a shopping card or a bank debit card.

14. A system for allowing a user to make a garment tailored to size, characterized in that it comprises:

a tailoring apparatus equipped with cutting and sewing means;

a plurality of operating instructions configured to be loaded into at least one processor in such a way as to allow performance of the following steps:

measuring on at least one captured image, representing a sample garment of the same type as the tailored garment to be made and also representing a reference object with actual standardized dimensions, the dimensions of the reference object and a plurality of basic dimensions of the sample garment;

calculating the actual dimensional values of the set of basic dimensions of the sample garment as a function of: the dimensional values of the set of basic dimensions of the sample garment measured on the at least one image;

the dimensional values of the reference object measured on the image, and the information on the actual dimensions of the reference object;

selecting the aesthetic features of the tailored garment to be made;

transmitting to the tailoring apparatus the calculated actual values of the set of basic dimensions of the sample garment and the selected aesthetic features, the tailoring apparatus being configured to allow performance of a sequence of operations of cutting and sewing the tailored garment based on the actual calculated values of the dimensions of the sample garment and the selected aesthetic features transmitted to the tailoring apparatus, in order to make the tailored garment so its basic dimensions are substantially equal to the previously calculated actual values of the basic dimensions of the sample garment and having also the selected aesthetic features.

15. The system according to claim 14, wherein at least part of the information resides in a remote processor and is configured to make an interface accessible to the user to allow entry of the at least one image representing the sample garment and the reference object having actual standardized dimensions.

16. A computer program stored on a non-transitory computer-readable medium, the computer program being suitable for use on a system for making a tailored garment, wherein when the program is loaded in a memory and executed, the program causes the system to:

receive at least one image comprising a sample garment of a same type as a tailored garment to be made and also comprising a reference object with actual standardized dimensions;

measure on the at least one image the dimensions of the reference object and a set of basic dimensions of the sample garment;

calculate the actual dimensional values of the set of basic dimensions of the sample garment as a function of: the dimensional values of the set of basic dimensions of the sample garment measured on the image, the dimensional values of the reference object measured on the image, and the actual dimensions of the reference object;

receive user input indicative of selected aesthetic features of the tailored garment to be made;

transmit to a tailoring apparatus the calculated actual dimensional values of the set of basic dimensions of the sample garment and the selected aesthetic features; and perform on the tailoring apparatus a sequence of operations of cutting and sewing the tailored garment, to make the tailored garment so its basic dimensions are substantially equal to the previously calculated actual dimensional values of the set of basic dimensions of the sample garment and so it has also the selected aesthetic appearance.

* * * * *